US005754991A

United States Patent [19]

Drozdowich et al.

[11] Patent Number: 5,754,991

[45] Date of Patent: *May 26, 1998

[54] APERTURED COUNTERTOP MOUNTING UNIT

[76] Inventors: Bryan Gordon Drozdowich, 32612 Hacienda Place, Clearbrook, British Columbia, Canada, V2T 1H6; Peter Zurba, 8557 Woodridge Place, Burnaby, British Columbia, Canada, V5A 4V3

[ * ] Notice: The term of this patent shall not extend beyond the expiration date of Pat. No. 5,551,103.

[21] Appl. No.: 601,295

[22] Filed: Feb. 16, 1996

Related U.S. Application Data

[63] Continuation-in-part of Ser. No. 291,663, Aug. 17, 1994, Pat. No. 5,551,103.

[51] Int. Cl.[6] ..... E03C 1/33

[52] U.S. Cl. ..... 4/631

[58] Field of Search ..... 4/631–635, 660

[56] References Cited

U.S. PATENT DOCUMENTS

| | | | |
|---|---|---|---|
| 4,374,695 | 2/1983 | Ikeda et al. | 4/632 |
| 5,016,297 | 5/1991 | Sauter et al. | 4/619 |

FOREIGN PATENT DOCUMENTS

| | | | |
|---|---|---|---|
| 2917144 | 11/1980 | Germany . | |
| 3420532 | 12/1985 | Germany . | |
| 4041586 | 10/1991 | Germany . | |
| 0159932 | 12/1980 | Japan | 4/632 |
| 2224648 | 5/1990 | United Kingdom | 4/632 |
| 2242626 | 10/1991 | United Kingdom | 4/632 |

*Primary Examiner*—Charles E. Phillips
*Attorney, Agent, or Firm*—Trask, Britt & Rossa

[57] ABSTRACT

An apertured mounting unit comprises a deck sheet with a top and a bottom surface, the deck sheet has a cross-sectional edge defining an aperture. A non-porous seal ring abuts the edge, the seal ring has top and bottom surfaces. The bottom surface of the seal ring adjacent to the cross-sectional edge is generally coplanar with the adjacent bottom surface of the deck sheet. A sink with an upper circumferential flange may be mounted on the bottom surface of the deck sheet, with the flange in sealing engagement with the seal ring.

8 Claims, 4 Drawing Sheets

APERTURED COUNTERTOP MOUNTING UNIT

This application is a continuation-in-part of copending International Application No. PCT/CA95/00482, which designates the U.S., with an international filing date of 17 Aug., 1995, that International Application is itself a continuation-in-part of U.S. application Ser. No. 08/291,663, filed 17 Aug., 1994, now U.S. Pat. No. 5,551,103.

FIELD OF THE INVENION

The invention is in the field of countertop mounting units, such as sink mounts. More particularly, the invention relates to sealing means associated with sink mounts and the like.

BACKGROUND OF THE INVENTION

Laminated countertops are typically constructed with a thin surface layer of plastic laminate (such as FORMICA™ brand laminate from the Formica Corporation, Cincinnati, OH). The laminate is generally made up of layers of colored paper impregnated with polymeric resin and pressed into sheet stock. The surface laminate is typically bonded to a wood fibre core, such as plywood, particle board or flake board.

To mount a sink in a laminated countertop, a cross-sectional hole must be cut through the laminate and core. The wood fibre core exposed by the cross-sectional cut is generally porous, so that a seal must be used to exclude water from the unlaminated, cut edge of the countertop. Typically, this is achieved by dropping a sink with an upper circumferential flange into the mounting aperture from above. In some cases, steps may be taken to seal the flange against the laminated countertop.

The traditional method of mounting flanged drop-in sinks gives rise to a number of problems. For example, it is not convenient to run cleaning solution over the flange, since the cleaner would not run back into the sink but out over the countertop. Wiping the countertop next to the flange tends to have the effect of forcing water, dirt and debris under the flange.

If the seal between the sink flange of a drop-in sink and the countertop laminate deteriorates, water can leak down into the exposed porous wood fibre edge of the countertop core. The positioning of the flange above the wood fibre edge facilitates this undesirable downward flow into the core. Eventually, the countertop may suffer structural failure as the wetted core first swells, then looses its structural integrity altogether. Even before the fibre core fails, however, the area beneath a leaking sink flange may become an unsanitary habitat for the proliferation of microorganisms.

Solid countertops, such as granite, have long provided an alternative to laminated countertops. Although advantageous, solid surface countertops were initially too expensive for the mass market. In the 1960's, E.I. du Pont de Nemours and Company developed an alumina trihydrate filled methylmethacrylate polymer solid surface countertop material, marketed under the trade-mark CORIAN™. Similar polyester resin based "cast marble" synthetic products are also available, such as AVONITE™ (by Avonite, Inc., Belen, N.M.), FOUNTAINHEAD™ (by the Neveman Division of International Paper, Odenton, Md.) and SURELL™ (by Wilden Industries, Inc.). These solid surface materials generally have high temperature resistance, low thermal expansion, low water absorption (they are non-porous) and are hard and impact resistant. The widespread market acceptance of novel solid surface materials has led in turn to new developments in kitchen and bathroom fixtures.

Unlike laminated countertops, solid surface countertops lack a porous wettable core. As a result, a sink may be mounted to the underside of an aperture cut in a solid surface countertop, and the non-porous cross-sectional edge of the countertop left exposed without risk of damage to the countertop. To take advantage of this feature, a wide range of sinks are available that have been adapted for installation below countertop surfaces. These undermount sinks generally include an upper peripheral flange adapted to seal against the underside of a solid surface countertop.

At least in part because of the problems inherent in the typical method of top-mounting drop-in sinks, undermount sinks have gained widespread acceptance for use with solid surface countertops. Unfortunately, solid surface countertops remain significantly more expensive than laminated countertops. As yet, however, no workable marriage exists between the economic advantages of laminated countertops and the aesthetic and functional advantages of undermount sinks.

SUMMARY OF THE INVENTION

It is an object of the invention to facilitate the use of undermount sinks with laminated countertops.

The invention provides an apertured mounting unit comprising a deck sheet with a top and a bottom surface. An aperture is cut in the deck sheet, so that the deck sheet has a cross-sectional edge that defines the aperture. The edge of the deck sheet exposed in cross-section is generally porous (relative, for example, to the surface of a laminated countertop). This is the case, if, for example, the deck sheet core is comprised of plywood, particle board or flake board. A non-porous, and preferably rigid, seal ring abuts up against, and may be glued to, the cross-sectional deck sheet edge. The seal ring, like the deck sheet, has top and bottom surfaces.

The top and bottom surfaces of the seal ring adjacent to the edge of the deck sheet may be coplanar with the top and bottom surfaces of the deck sheet. In some embodiments, 1/16 inch to ¾ inch of the bottom surface of the seal ring adjacent to the cross-sectional edge may be coplanar with the adjacent bottom surface of the deck sheet, so that an undermount sink (or other utility member) may be sealably mounted against the bottom surface of the seal ring. Sealing engagement between the sink flange and the seal ring may be facilitated if the bottom planar surface of the seal ring is at least ¼ inch wide. If the top surface of the seal ring is coplanar with the top surface of the deck sheet, a countertop laminate may be sealed across the top surface of the seal ring and the top surface of the deck sheet. Any appropriately flanged appliance or fixture may be attached as a utility member to the underside of the countertop in sealing abutment with the bottom surface of the seal ring.

To manufacture the apertured mounting unit according to one embodiment of the invention, a deck sheet is provided. The deck sheet has top and bottom surfaces. An aperture is cut in the deck sheet, to form a cross-sectional edge on the deck sheet defining the aperture. The cross-sectional cut in the deck sheet exposes the porous core of the deck sheet. A seal ring, preferably rigid, having top and bottom surfaces, is formed. The seal ring is dimensioned to fit inside the aperture and abut the edge of the deck sheet. The seal ring is inserted into the aperture in abutment with the cross-sectional edge of the deck sheet. The top and bottom surfaces of the seal ring adjacent to the edge may be coplanar with the adjacent top and bottom surfaces of the deck sheet. The top surface of the deck sheet and the seal ring may be covered with a layer of laminate, sealing over the top of the joint between the seal ring and the deck sheet.

In one embodiment, the seal ring is formed by cutting at least two strips of appropriately dimensioned seal ring material from seal ring sheet stock. The strips of seal ring material are then heated to a temperature at which the strips are deformable. The strips may then be molded, each to an appropriate shape to fit against a portion of the deck sheet edge. The strips may then be bonded together to form the complete seal ring. A groove may then be cut in the bottom surface of the seal ring, into which a resilient gasket may be sealably seated. Alternatively, the gasket material may be applied to the seal ring as a bead of hardenable liquid.

The ready-made combination of deck sheet and seal ring may be conveniently shipped to consumers for final installation as a mounting unit. An appropriately dimensioned laminated mounting unit may be fitted as one piece of a modular countertop, using standard countertop assembly methods. If the mounting unit is not laminated, final installation may be accomplished by joining the mounting unit to the remainder of a countertop core, the top and bottom surfaces of the mounting unit being aligned respectively with the top and bottom surfaces of the countertop core. Then, the top surface of the countertop, including the deck sheet and the top surface of the seal ring may be laminated. Once bonded, the countertop laminate layer seals against the top surface of the seal ring and deck sheet, to provide a countertop liquid barrier to keep water and other liquids away from the porous cross-sectioned core of the countertop exposed at the edge of the deck sheet. Excess laminate sheet may be trimmed from the countertop surface. As part of the trimming process, the solid surface ring seal material may be sanded or routed to an aesthetic and functional finished shape.

Once the mounting unit is in place in a countertop, an undermount sink, or other fixture, may be affixed to the bottom surface of the mounting unit. To seal the upper peripheral sink flange to the bottom surface of the seal ring, a bead of appropriate liquid sealant, such as silicone, may be applied to the bottom surface of the seal ring before the sink flange is clamped to the bottom surface of the mounting unit. In addition, a resilient gasket may be used to help seal the sink flange to the seal ring. The gasket may be seated in, and protrude downwardly from, a channel in the bottom surface of the seal ring. Alternatively, the gasket may be applied to the planar bottom surface of the ring. When the sink is in place, the gasket may sealingly abut the sink flange. The seal between the sink flange and the bottom surface of the ring seal provides a counter-bottom liquid barrier to keep water and other liquids away from the porous cross-sectioned core of the deck sheet.

When the seal ring is installed between a layer of countertop laminate and an undermount sink flange, it acts as a gasket, sealing the space between the countertop laminate and the undermount sink flange. The seal ring thereby isolates the relatively porous cross-sectioned core of the deck sheet from any liquid. A further barrier is provided by the abutment of the seal ring itself against the cross-sectional edge of the deck sheet. The seal ring may be glued to the cross-sectional edge, the adhesive providing a further barrier to keep liquid away from the porous core of the deck sheet.

Although the deck sheet may be comprised of wood fibre material such as plywood, particle board or flake board, the deck sheet may be made of a dense water-resistant board, such as MEDITE™ or MEDIX™ brand board (manufactured by the Medite Corporation, Medford, Oreg.). The use of such board further reduces the risk of water damage to the cross-sectioned edge of the deck sheet.

The thickness of the deck sheet may be tailored to match the standard thickness of laminated countertop core materials in common use. In many areas of North America, for example, this will correspond to ⅝ inch board. Similarly, the deck sheet may be cut to overall dimensions that facilitate installation of the mounting unit with standard laminated countertops, 27 inches wide by 49 inches long being one preferred size in North America.

The seal ring may be made of molded plastic, such as cured polyester or acrylic resin based plastics. The plastic may be comprised of solid surface countertop material, such as CORIAN™ brand sheet from the Dupont Company (methylmethacrylate polymer and alumina trihydrate filler) or FOUNTAINHEAD™ brand solid surface material (homogeneous, thermoset polymer alloy, comprised of polyester and acrylic components and filled with aluminium trihydrate).

A wide variety of solid surface countertop materials are available in standard sheet forms of varying thickness. To produce the seal ring of the invention, appropriate solid surface sheet material may be cut into appropriately dimensioned strips which are then heat formed to an appropriate shape. The temperature and duration of heat forming will vary with the material used. 315° Fahrenheit (F)—330° F. is in some embodiments appropriate for CORIAN™ brand material, while 260° F.–290° F. may be suitable in some embodiments for polyester resin based materials such as KARADON™, AVONITE™, FOUNTAINHEAD™, SURELL™ or GIBRALTAR™. The duration of heating will also vary with material size and composition, 15 to 20 minutes being suitable for some ⅝"×½" strips of CORIAN™ brand material. Those skilled in the art will appreciate that variations in these specifications are appropriate in some circumstances, to produce the desired deformation of the solid surface material.

It is also be possible to injection mold appropriate seal rings in a unitary form. Alternatively, material may be extruded into strips that can be cut, bent and joined to form appropriate seal rings. In some embodiments, the outer peripheral surface of the ring may have protrusions or indentations that mate with corresponding indentations or protrusions on the cross-sectional edge of the deck sheet.

The cross-sectional edge of the deck sheet may be bevelled inwardly from the top surface of the deck sheet to the bottom surface, so that the top of the edge projects further into the aperture than the bottom of the edge. In this embodiment, the seal ring has a corresponding bevel, which may, for example, be 3 degrees from vertical.

A method of manufacturing an apertured mounting unit in accordance with the invention may comprise the steps of:

providing a deck sheet having a top surface and a planar bottom surface;

cutting an aperture in the deck sheet, to form a cross-sectional edge in the deck sheet defining the aperture;

forming a non-porous seal ring having a top surface and a planar bottom surface, the seal ring being dimensioned to fit inside the aperture and abut the edge of the deck sheet; and, inserting the seal ring into the aperture in abutment with the cross-sectional edge of the deck sheet, so that the planar bottom surface of the seal ring is coplanar with the planar bottom surface of the deck sheet.

A method of forming the seal ring may further comprise of the steps of:

providing at least two strips of appropriately dimensioned seal ring material selected from the group consisting of polyester resins; acrylic resins; cast acrylic resins with inert filler; mineral filled polyester resins; mineral filled acrylic resins; methylmethacrylate polymers with alumina trihydrate fillers; thermoset polymer alloys comprised of polyester and acrylic components and filled with aluminium trihydrate;

heating the strips of seal ring material to a temperature at which the strips are deformable;

molding the heated strips to an appropriate shape to fit against a portion of the deck sheet edge; and bonding the strips of seal ring material together to form the seal ring.

The method of forming the seal ring may further comprise the step of providing a resilient gasket on the bottom surface of the seal ring.

A method of installing the apertured mounting of the invention may comprise the steps of:

providing an apertured mounting unit comprising:

a deck sheet with a top and a bottom surface, the deck sheet having a cross-sectional edge defining an aperture; and, a non-porous seal ring abutting the edge, the seal ring having top and bottom surfaces, the top and bottom surfaces of the seal ring adjacent to the edge being generally flush with adjacent top and bottom surfaces of the deck sheet the a top surface of the mounting unit comprised of the top surfaces of the sheet deck and the seal ring, and a bottom surface comprised of the bottom surfaces of the sheet deck and the seal ring;

providing a countertop core having top and bottom surfaces;

joining the apertured mounting unit to the countertop core, the top and bottom surfaces of the mounting unit being aligned respectively with the top and bottom surfaces of the countertop core;

bonding a laminate sheet to the top surfaces of the countertop core and the mounting unit, to provide a countertop surface seal spanning the junctions between the seal ring, deck sheet and countertop core;

trimming excess laminate sheet from the countertop surface;

providing a utility member with a flange adapted for under-mounting to a countertop aperture;

sealingly affixing the flange of the utility member to the bottom surface of the seal ring.

DETAILED DESCRIPTION

Figure 1:
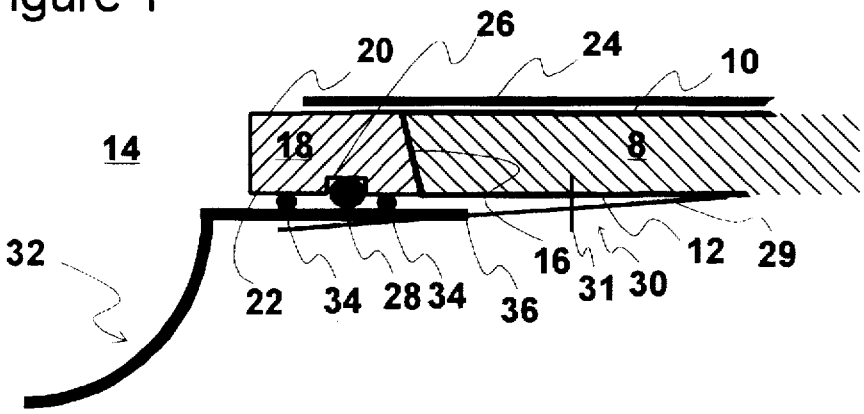
FIG. 1 is a partially fragmented cross-sectional view of the mounting unit showing an undermount sink and laminated countertop.
Figure 2:
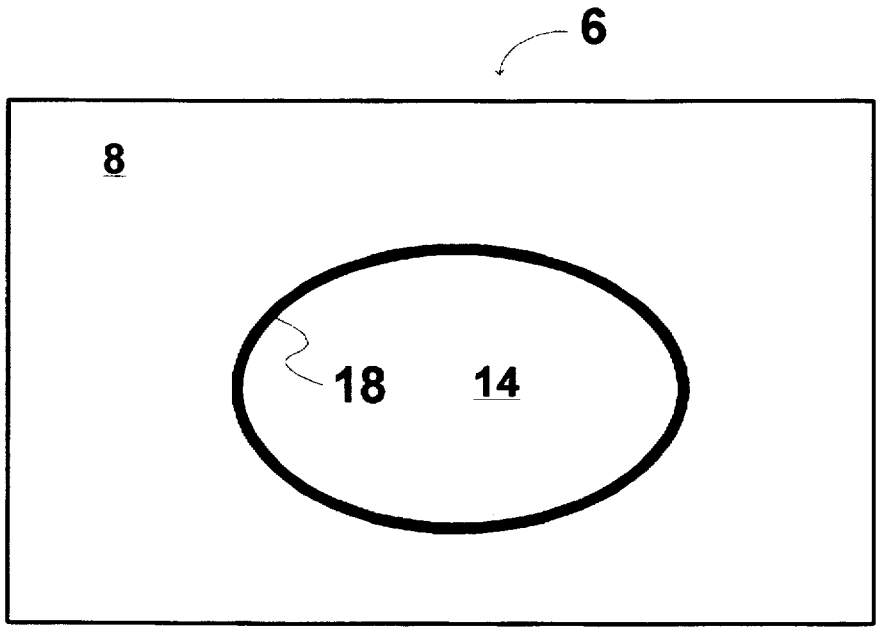
FIG. 2 is a plan view of an apertured mounting unit, showing the seal ring in the aperture defined by the deck sheet.

As shown in FIGS. 1–4, apertured mounting unit 6 comprises deck sheet 8 and seal ring 18. Deck sheet 8 may be made of dense water-resistant board (such as MEDIX™ brand) and may have a planar top surface 10 and a planar bottom surface 12. Of course, the entire top and bottom surfaces of deck sheet 8 need not be planar. (In general, when a part is described herein as having a planar top or bottom surface, it will be understood that this does not dictate that the all of the top or bottom surfaces of such a part are planar.)

Figure 3:
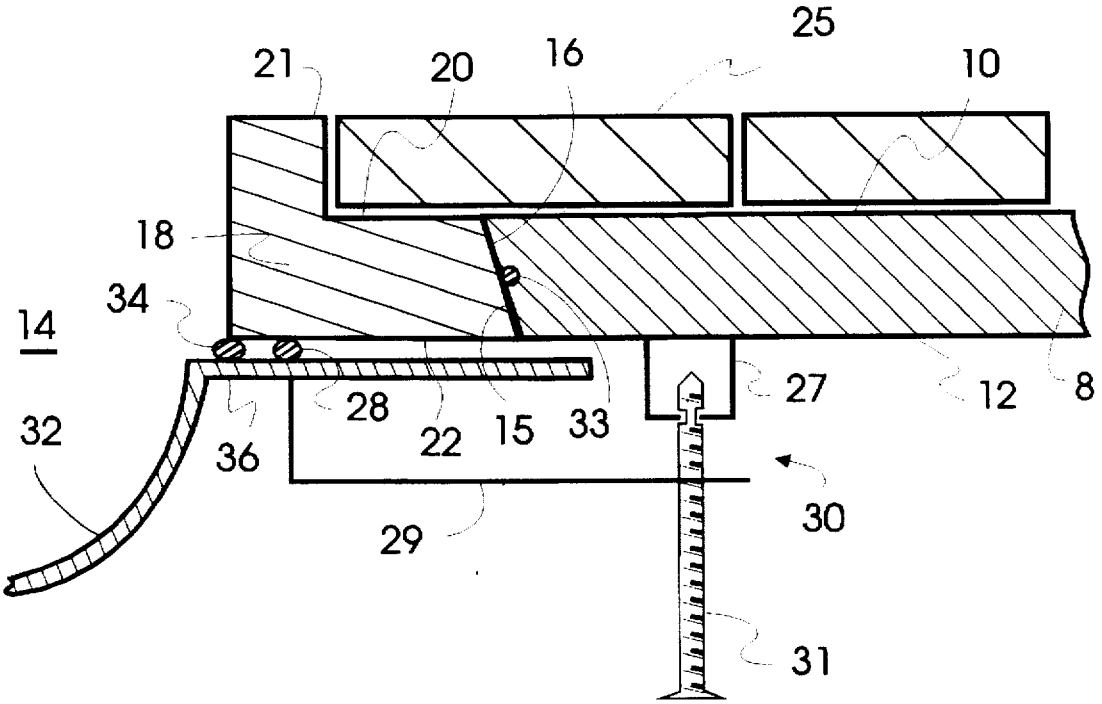
FIG. 3 is a partially fragmented cross-sectional view of the mounting unit, showing an undermount sink and tile countertop.

Cross-sectional edge 16 of deck sheet 8 defines aperture 14. At least a portion of cross-sectional edge 16 may be bevelled inwardly from the top surface of deck sheet 8 to the bottom surface, so that in the bevelled portion of cross-sectional edge 16, an upper segment of edge 16 projects further into aperture 14 than a lower segment of edge 16. Such bevelling may act to restrict the upward movement of seal ring 18 with respect to deck sheet 8. As shown in FIGS. 1 and 3, the bevelled portion of cross-sectional edge 16 may be generally straight in vertical cross section and may meet planar bottom surface 12 of deck sheet 8 at an obtuse angle and may meet planar top surface 10 of deck sheet 8 at an acute angle. The bevel may, for example, be approximately 3 degrees from vertical.

A non-porous seal ring 18 may be glued to deck sheet edge 16. Seal ring 18 may be rigid and may be made of heat formed CORIAN™ brand solid surface material (methylmethacrylate polymer and alumina trihydrate filler). Seal ring 18 may have a planar top surface 20 and a planar bottom surface 22.

Outer peripheral surface 15 of seal ring 18 may be bevelled to match the bevel of cross-sectional edge 16, for example by 3 degrees from vertical. Top surface 20 and bottom surface 22 of seal ring 18 may be flush with top surface 10 and bottom surface 12 of deck sheet 8, as shown in FIGS. 1 and 3.

As shown in FIG. 1, countertop laminate 24 may be bonded to top surface 10 of deck sheet 8 and bonded to a portion of top surface 20 of seal ring 18, providing a seal across the top of cross-sectional edge 16. Clamps 30 may be used to affix undermount sink 32 to the underside of mounting unit 6. Clamps 30 may comprise plate 29 and securing means (such as a screw or bolt) 31 secured to deck sheet 8 for biasing plate 29 against sink flange 36. By securing clamps 30 to deck sheet 8, the weight of sink 32 is born by deck sheet 8 and not by seal ring 18.

Figure 4:
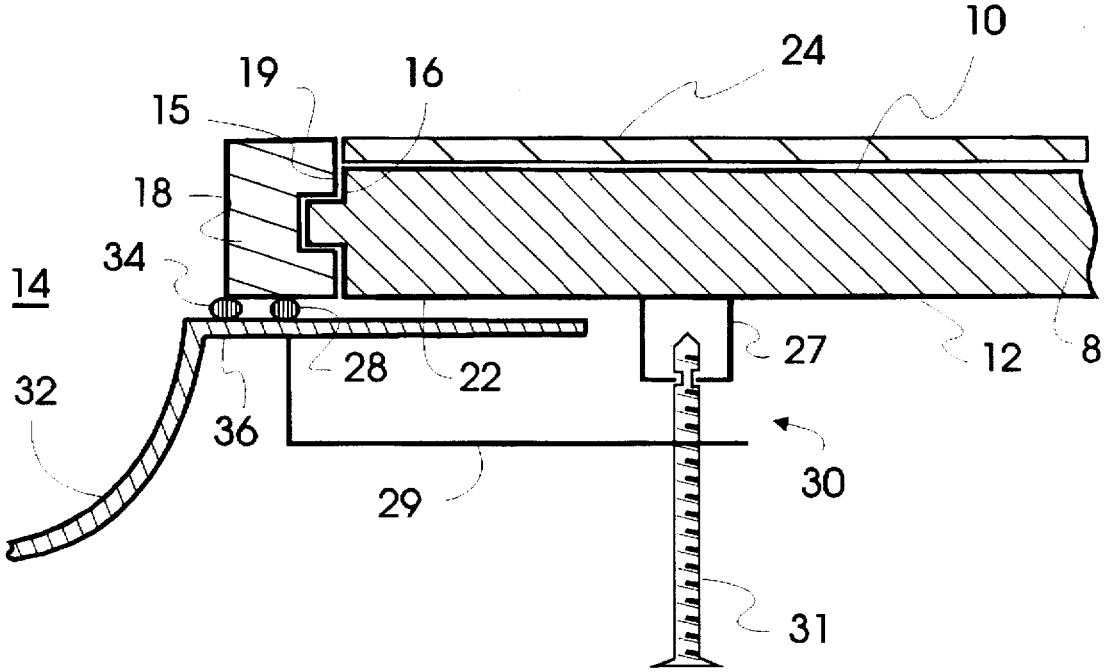
FIG. 4 is a partially fragmented cross-sectional view of the mounting unit, showing an undermount sink and a laminated countertop.

Resilient gasket 28 seated in groove 26 in bottom surface 22 of seal ring 18 may be compressed by sink flange 36 when clamp 30 is secured to deck sheet 8 by securing means 31. Clamp 30 may be tightened to bias sink flange 36 against seal ring 18. Gasket 28 on the bottom surface 22 of ring 18 may be applied to bottom surface 22 or ring 18 as a bead of hardenable gasket material, obviating the need for groove 26, as shown in FIGS. 3 and 4.

The bevel of cross-sectional edge 16 of deck sheet 8 may help to ensure that seal ring 18 is not displaced when clamp 30 is secured. Beads of silicone sealant 34 may be used to help seal peripheral sink flange 36 to bottom surface 22 of seal ring 18.

To manufacture apertured mounting unit 6, aperture 14 may be cut in deck sheet 8, forming cross-sectional edge 16. If deck sheet 8 is comprised of wood fibre board, as is often the case in commercial laminated countertops, cross-sectional edge 16 of deck sheet 8 may be relatively porous.

A rigid, non-porous seal ring 18, having top surface 20 and bottom surface 22 may be formed for installation in deck sheet 8. Seal ring 18 is dimensioned to fit inside aperture 14 and abut cross-sectional edge 16. Seal ring 18 may be inserted into aperture 14 in abutment with cross-sectional edge 16, and may be glued into place against edge 16. Top surface 20 and bottom surface 22 of seal ring 18 may be coplanar with adjacent top surface 10 and bottom surface 12 of deck sheet 8.

Seal ring 18 may be formed by cutting two strips of appropriately dimensioned seal ring material from CORIAN™ brand sheet stock. The strips of seal ring material may then be heated to a temperature at which the strips are deformable, 315° F.–330° F., 15 to 20 minutes of heating being suitable for some ⅝"×½" strips of CORIAN™ brand material. The strips of seal ring material may then be molded, each to an appropriate shape to fit against a portion of deck sheet edge 16, and allowed to cool. The molded strips may then be bonded together, by methods known in the solid surface fabrication art, to form complete seal ring 18. Groove 26 may be cut in bottom surface 22 of seal ring 18. Resilient gasket 28 may then be sealably seated in groove 26. Alternatively, gasket 28 may be applied to bottom surface 22 of seal ring 18 as a bead of hardenable liquid which adheres to bottom surface 22, in which case groove 26 may not be necessary.

To install mounting unit 6 in a countertop, top surface 10 and bottom surface 12 of deck sheet 8 may be aligned respectively with the top and bottom surfaces of an adjacent countertop core sheeting. Once mounting unit 6 is affixed adjacent to the remaining countertop core, the entire top surface of the countertop, including top surface 10 of deck sheet 8 and top surface 20 of seal ring 18 may be laminated.

Once mounting unit 6 is installed, utility member 32, such as an undermount sink 32, may be mounted to the bottom surface 12 of deck sheet 8. In affixing utility member 32 to bottom surface 22 of seal ring 18, beads of silicone sealant 34 may be applied to bottom surface 22 of seal ring 18. Clamps 30 may be used to affix undermount sink 32 to the underside of mounting unit 6.

Seal ring 18 may be installed in an existing, previously laminated, countertop in a number of ways (the countertop comprising deck sheet 8 covered by laminate 24). A hole may first be cut in the laminated countertop (a hole may already be present if, for example, a drop-in sink has previously been installed in the countertop).

To install ring 18 in a previously laminated countertop, the laminated countertop may be turned upside-down and a router used to remove an annular portion of deck sheet 8 from beneath the laminate 24 around the periphery of the hole in the countertop, to form aperture 14. It may be convenient, especially if the laminated countertop is a cove-top design, to use a spacer (such as a sheet of plywood) between the bottom of the countertop and the router, so that the configuration of the countertop bottom does not interfere with the path travelled by the router (otherwise, in some cove-top countertop designs in particular, the router may be blocked from the required path of travel by the downwardly depending front edge of the countertop). As an alternative to operating the router on the bottom side of deck sheet 8, the router may be used from the top side of the countertop and set to undercut laminate 24. If the router is to be operated by hand, whether the router is used from the top side or the bottom side of the laminated countertop, the router may be guided by a guiding template, with a cut-out within which the router travels. Alternatively, an automated router may be programmed with appropriate cutting coordinates, so that no template is required.

When installing ring 18 in a countertop which has already been laminated, to avoid damaging laminate 24, the router may be adjusted, at least on the first pass, to leave a portion of deck sheet 8 attached to the underside of laminate 24 around the periphery of the hole in the countertop. The router may then be recalibrated and used again to remove another annular portion of deck sheet 8 from the underside of laminate 24. Portions of deck sheet 8 remaining on the underside of the annular, under-cut portion of laminate 24 may also be removed with a chisel or similar tool if desired. A thin portion of deck sheet material that may remain beneath the under-cut portion of laminate 24, may be treated with a penetrating compound that sets to render such deck sheet material generally impervious to water.

Once an annular portion of deck sheet 8 has been removed from the periphery of the hole in the laminated countertop, deck sheet 8 defines aperture 14. Ring 18 may then be installed beneath the annular, under-cut portion of laminate 24, so that bottom planar surface 22 of ring 18 may be coplanar with bottom surface 12 of deck sheet 8. Ring 18 may be attached to the underside of laminate 24 by adhesive, such as contact cement or silicone adhesive. Similar adhesives may also be used to affix ring 18 to cross-sectional edge 16 of deck sheet 8.

Ring 18 may be installed as part of the process of making laminated countertop on a large scale, such as commercial processes for producing cove-top countertop. In accordance with this embodiment of the invention, it will be appreciated that deck sheet 8 may be provided in a variety of shapes and sizes, such as the common cove-top configuration with an upwardly projecting backsplash portion at the rear of the countertop and a downwardly depending lip at the front of the countertop. To manufacture a section of countertop which includes ring 18, aperture 14 may be cut in deck sheet 8 and ring 18 installed in the aperture as discussed above. Top surface 10 of deck sheet 8 with attached ring 18 may then be laminated, so that top surface 20 of ring 18 is covered by laminate 24; aperture 14 may also be covered by laminate 24. The portion of laminate 24 overlying aperture 14 may then be removed, to expose aperture 14, with ring 18 around the periphery of aperture 14.

Embodiments of ring 18 may be adapted for use with tile countertops, as shown in FIG. 3. In this embodiment ring 18 may comprise a planar top surface 20 that is coplanar with the top surface 10 of deck sheet 8. The top of raised portion 21 of ring 18 adjacent to aperture 14 may be generally coplanar with the top surface of tiles 25. Tiles 25 rest on planar top surface 20 of ring 18 and planar top surface 10 of deck sheet 8, preferably spanning the joint between ring 18 and deck sheet 8, and abutting raised portion 21 of ring 18.

Ring 18 as shown in FIG. 3 with raised portion 21 may also be suited for use with a laminate countertop surface, instead of a tile countertop; in which case the top of raised portion 21 may be dimensioned to be generally coplanar with the top surface of the laminate and the laminate may be sealably attached to planar top surface 20 of ring 18.

As shown in FIG. 4, ring 18 may be made with an indentation in outer peripheral surface 15. In this embodiment, it may be convenient to make ring 18 out of extruded plastic, the extrusion having the appropriate profile. The profile of cross-sectional edge 16 may be adapted, for example by use of a suitable router bit, to mate with the profile of ring 18, so that ring 18 and deck sheet 8 mate when jointed. In accordance with this embodiment, outer peripheral surface 15 of ring 18 may of course be provided with a wide range of indentations or extensions and cross-sectional edge 16 profiled correspondingly to mate with ring 18.

As shown in FIGS. 3, outer peripheral surface 15 of ring 18 may be provided with a protrusion 33 (which may be a pliable circumferential protrusion, such as an O-ring, which may be seated in a groove or applied as a bead of hardenable liquid). The surface of cross-sectional edge 16 may be provided with an indentation that is adapted to mate with protrusion 33 on ring 18. With this construction, ring 18 may "snap" into place in aperture 14. For example, when ring 18 is pressed into aperture 14, a pliable circumferential protrusion 33 may first be compressed and then expand when it reaches the matching indentation in cross-sectional edge 16. Protrusion 33 on ring 18 may be useful to hold ring 18 in place relative to deck sheet 8 while adhesive sets. Providing protrusion 33 on ring 18 may make it possible in joining ring 18 to deck sheet 8 to avoid the use of clamps and to use different types of adhesive (adhesives that set more quickly, for example).

As shown in FIG. 4, a top surface 19 of ring 18 may project above top surface 10 of deck sheet 8. This embodiment of the invention may be useful, for example, for use with tile countertops. Tiles (not shown in FIG. 4) or laminate 24 may abut outer peripheral surface 15 of ring 18. In one such embodiment, ring 18 and laminate 24 may be comprised of bondable solid surface material (such as the laminate material called "Wilsonart Solid Surfacing Veneer" and the ring material FORMSTONE™, both of these materials are manufactured by Aristech Chemical Corp. of Florence, Ky.); in which case catalysed bonding adhesive may be used to join laminate 24 to ring 18. The sealed joint between laminate 24 and ring 18 may help prevent liquids from seeping into deck sheet 8. Similarly, in a tile countertop, grout may be used to seal the junction between tile 25 and ring 18.

Clamps 30 may be used as means for removably supporting the utility member 32 on the bottom surface 12 of deck sheet 8. As shown in FIGS. 3 and 4, clamp 30 comprises bracket 27 affixed to bottom surface 12 of deck sheet 8. Screw 31 rotatably engages bracket 27. Plate 29 is threaded on screw 31, so that rotation of screw 31 causes plate 29 to move up or down. Plate 29 may be biased against flange 36 by rotating screw 31.

Figure 5:
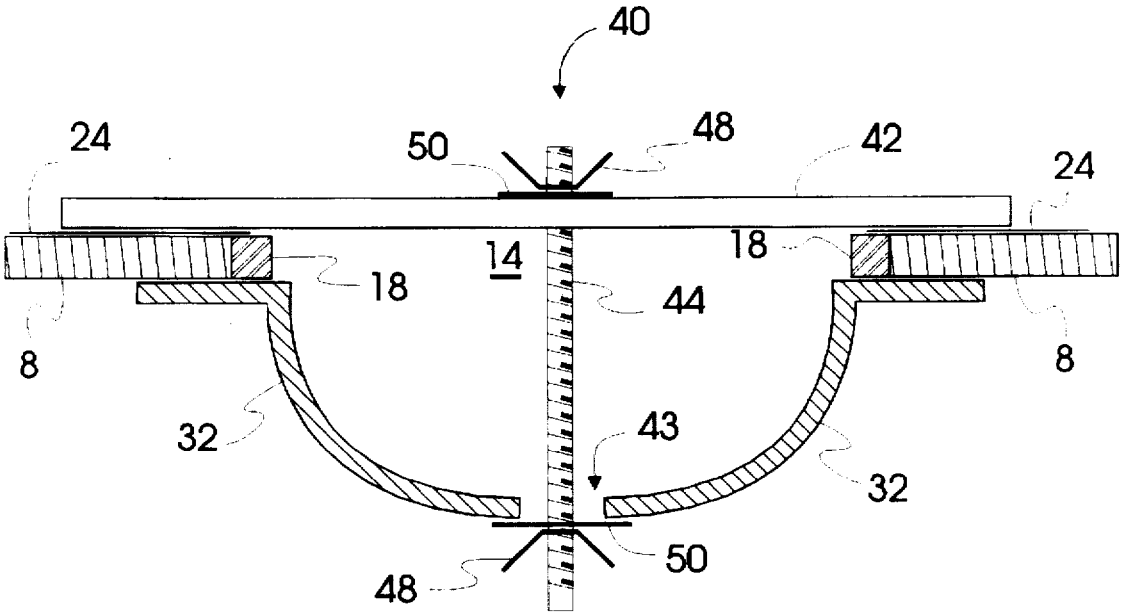
FIG. 5 is a cross-sectional view of the mounting unit, showing an undermount sink held in place with a hanging tool.

As shown in FIG. 5, to install utility member 32, such as an under-mount sink, it may be useful to use hanging tool 40 that holds sink 32 in place from above aperture 14. Board 42 may be provided spaning aperture 14. Threaded member 44 may be passed through a hole (not shown) in board 42. Threaded member 44 depends downwardly from board 42 through the drain hole 43 in sink 32. Nuts 48 and washers 50 of appropriate dimension may used at either end of treaded member 44 to hold sink 32 suspended from board 42. Sink 32 may be raised into position towards the bottom surface 22 of seal ring 18 by adjusting nuts 48 on threaded member 44.

As will be apparent to those skilled in the art in the light of the foregoing disclosure, many alterations and modifications are possible in the practice of this invention without departing from the spirit or scope thereof. For example, the mounting unit according to the invention may be used with a variety of fixtures or utility members, other than sinks, such as cutting boards, tubs, waste and recycling bins, even fish tank lids or port holes. Accordingly, the scope of the invention is to be construed in accordance with the substance defined by the following claims.

What is claimed is:

1. An apertured mounting unit comprising:

a deck sheet with a top surface and a planar bottom surface, the deck sheet having a cross-sectional edge defining an aperture in the deck sheet;

a non-porous seal ring, the outer peripheral surface of the seal ring abutting the cross-sectional edge, the inner peripheral surface of the seal ring defining an opening, the seal ring having a top surface and a planar bottom surface, the planar bottom surface of the seal ring being coplanar with the planar bottom surface of the deck sheet;

a utility member having a circumferential outwardly extending flange adapted for sealing engagement with the planar bottom surface of the seal ring and adapted to abut the planar bottom surface of the deck sheet, the utility member being supported on a bottom surface of the deck sheet; and, means for removably supporting the utility member on the bottom surface of the deck sheet so that the circumferential outwardly extending flange of the utility member is removably held against the planar bottom surface of the deck sheet and in sealable engagement with the planar bottom surface of the seal ring.

2. The apertured mounting unit of claim 1, wherein the seal ring is comprised of a solid surface material selected from the group consisting of polyester resins; acrylic resins; cast acrylic resins with inert fillers; mineral filled polyester resins; mineral filled acrylic resins; methylmethacrylate polymers with alumina trihydrate fillers; and, homogeneous, thermoset polymer alloys comprised of polyester and acrylic components and filled with aluminium trihydrate.

3. The apertured mounting unit of claim 1, wherein at least a portion of the cross-sectional edge is bevelled so that in the bevelled portion of the cross-sectional edge an upper segment of the cross-sectional edge projects further into the aperture than a lower segment of the cross-sectional edge, such that the bevelled portion of the cross-sectional edge restricts the upward movement of the seal ring with respect to the deck sheet.

4. The apertured mounting unit of claim 3, wherein the bevelled portion of the cross-sectional edge is generally straight in vertical cross section and meets the planar bottom surface of the deck sheet at an obtuse angle and meets the planar top surface of the deck sheet at an acute angle.

5. The apertured mounting unit of claim 1, further comprising:

a protrusion on an outer peripheral surface of the seal ring; and, an indentation on the cross-sectional edge of the deck sheet;

wherein the protrusion and the indentation are matable when the seal ring abuts the cross-sectional edge.

6. The apertured mounting unit of claim 1, further comprising a resilient gasket on the planar bottom surface of the seal ring.

7. The apertured mounting unit of claim 1, wherein the top surface of the deck sheet and the top surface of the seal ring are coplanar, further comprising a laminate sheet bonded to the top surface of the deck sheet and in sealing engagement with the top surface of the seal ring.

8. The apertured mounting unit of claim 1, wherein the top surface of the deck sheet and the top surface of the seal ring are coplanar, further comprising a tile bonded to the top surface of the deck sheet and in sealing engagement with the top surface of the seal ring, the seal ring further comprising a raised portion adjacent to the aperture against which the tile abuts.

* * * * *